US009051152B2

(12) United States Patent
Matthies et al.

(10) Patent No.: US 9,051,152 B2
(45) Date of Patent: Jun. 9, 2015

(54) DEVICE FOR WINDING UP A THREAD

(71) Applicant: Oerlikon Textile GmbH & Co. KG, Remscheid (DE)

(72) Inventors: Claus Matthies, Ehndorf (DE); Jan Westphal, Schülp (DE); Jörn Zühlke, Neumünster (DE); Friedrich Lennemann, Neumünster (DE)

(73) Assignee: OERLIKON TEXTILE GMBH & CO. KG, Remscheid (DE)

( * ) Notice: Subject to any disclaimer, the term of this patent is extended or adjusted under 35 U.S.C. 154(b) by 150 days.

(21) Appl. No.: 13/893,815

(22) Filed: May 14, 2013

(65) Prior Publication Data

US 2013/0248639 A1 Sep. 26, 2013

Related U.S. Application Data

(63) Continuation-in-part of application No. PCT/EP2011/070365, filed on Nov. 17, 2011.

(30) Foreign Application Priority Data

Nov. 20, 2010 (DE) ..... 10 2010 052 091
Jan. 20, 2011 (DE) ..... 10 2011 008 971

(51) Int. Cl.
*B65H 54/30* (2006.01)
*B65H 54/34* (2006.01)
(Continued)

(52) U.S. Cl.
CPC ..... *B65H 54/2836* (2013.01); *B65H 54/343* (2013.01); *B65H 54/346* (2013.01); *B65H 54/2839* (2013.01); *B65H 65/00* (2013.01); *B65H 2701/31* (2013.01)

(58) Field of Classification Search
CPC ..... B65H 54/2836; B65H 54/2839; B65H 54/34; B65H 54/343; B65H 54/346
USPC ..... 242/476.1–476.6
See application file for complete search history.

(56) References Cited

U.S. PATENT DOCUMENTS 4,040,572 A 8/1977 Melan et al.
4,057,195 A * 11/1977 Jones et al. ..... 242/476.1
(Continued)

FOREIGN PATENT DOCUMENTS

DE 81 16 938 10/1982
DE 38 31 341 4/1989
(Continued)

OTHER PUBLICATIONS

PCT/EP2011/070365 International Search Report dated Mar. 7, 2012 (8 pages including 3 page English translation).
(Continued)

*Primary Examiner* — William E Dondero
(74) *Attorney, Agent, or Firm* — Brinks Gilson & Lione; G. Peter Nichols

(57) ABSTRACT

A device for winding up a thread is described. The device has at least one spool spindle that can be driven and includes a spool housing with a thread catching device associated with the spool housing. The spool spindle is associated with a changing device for guiding the thread back and forth and an auxiliary device for guiding the thread when catching and laying down the thread. The auxiliary device includes at least one moveable metal guide having a guide edge or a guide groove for guiding the thread, such that the moveable guide can be guided between a transfer position in the area of the changing device and a parking position to the side next to the changing device. A stationary pin thread guide may be associated with the moveable guide in the parking position.

7 Claims, 6 Drawing Sheets

(51) Int. Cl.
*B65H 65/00* (2006.01)
*B65H 54/28* (2006.01)

(56) References Cited

U.S. PATENT DOCUMENTS

| | | | | | |
|---|---|---|---|---|---|
| 4,062,501 | A | * | 12/1977 | Eisenberg et al. | 242/474.5 |
| 4,069,984 | A | * | 1/1978 | Klink et al. | 242/476.1 |
| 4,085,901 | A | * | 4/1978 | Sanders | 242/476.1 |
| 4,193,557 | A | * | 3/1980 | Melan et al. | 242/476.1 |
| 4,205,800 | A | * | 6/1980 | Melan et al. | 242/476.1 |
| 5,653,395 | A | | 8/1997 | Iwade et al. | |
| 6,629,660 | B1 | | 10/2003 | Yamaguchi et al. | |
| 2005/0082416 | A1 | | 4/2005 | Brenk | |

FOREIGN PATENT DOCUMENTS

| | | |
|---|---|---|
| DE | 195 20 285 | 6/1996 |
| EP | 0 650 914 | 5/1995 |
| JP | 58 078964 | 5/1983 |

OTHER PUBLICATIONS

PCT/EP2011/070365 International Preliminary Report on Patentability dated May 21, 2013 (5 pages including 4 page English translation).

* cited by examiner

DEVICE FOR WINDING UP A THREAD

This application is a continuation-in-part of and claims the benefit of priority from PCT application PCT/EP2011/070365 filed Nov. 17, 2011; German Patent Application DE 10 2010 052 091.8 filed Nov. 20, 2010; and German Patent Application DE 10 2011 008 971.3 filed Jan. 20, 2011, the disclosure of each is hereby incorporated by reference in its entirety.

BACKGROUND

The invention relates to an apparatus for winding up of a thread.

A generic device for winding up a thread is known from DE 81 16 938 UI. Such devices are preferably used for the continuous winding up of an incoming thread. The thread is wound into a coil on the periphery of a spool housing. The spool housing is fixed on the circumference of a drivable spool spindle, wherein the spool spindle is preceded by a changing device for leading the threads back and forth. After the changing device, the thread is continuously stored by a pressure roller on the periphery of the coil to be wound.

Before the thread can be wound into a coil on the spool housing, it is necessary to catch the running thread and to wind it up. The thread is usually led by an auxiliary device, which takes over the thread from the changing device. These operations are required at each process start to wind the spool or, if two spool spindles held on a spool turret are used, at each exchange of the spool.

As an auxiliary means, the known device comprises a moveable metal guide, which has a guide edge and a guide groove, wherein the guide edge leads into the guide groove. By moving the moveable metal guide from a parking position, which is located laterally to the changing device, into a receiving position, which is located in the area of the changing device, the takeover of the thread by the changing device is initiated. After the thread slides over the guide edge into the guide groove of the moveable metal guide, the moveable metal guide is held in the catching position and moved back into the parking position. The parking position of the moveable metal guide is chosen such that the thread gets into contact with the thread-catching device at the spool spindle so that a new spool travel can begin. After the catch of the thread in the thread-catching device, the moveable metal guide is led again from the parking position into the receiving position. After reaching the receiving position, the moveable metal guide is led into the release position so that the thread is taken from the changing device. The back and forth movement of the moveable metal guide between the receiving position and the parking position for receiving and passing on the thread is relatively time consuming, which results in long changeover times.

Since the thread reserve held in the lateral region of a spool ultimately serves to tie the thread end of the spool with the thread beginning of a next spool to continue the process, the thread reserve winding is essentially determined by a minimum length of a piece of thread, which allows an unproblematic knotting. In that regard, the dwell time of the thread after its catching in the thread catching device until the takeover by the changing device governs the formation of the winding up of the thread reserve.

In the known device, in addition to the long dwell time there exist additional problems in that the release of the thread is done by the moveable metal guide in the region of the changing device. Thus, during the retraction of the moveable metal guide, the thread of the changing device could re-enter the thread-guiding groove of moveable metal guide.

SUMMARY

The technical task of the invention is to further develop a device for winding up a thread of the generic type in such a way that only pieces of thread as short as possible must be wound up on the circumference of a spool housing as a thread reserve.

Another goal of the invention is to provide a generic apparatus with the shortest possible change times of the spool change.

This technical task is resolved by the invention in that the moveable metal guide in the parking position is associated with a stationary thread-guide pin, which cooperates with a guide shaft for guiding the thread by the guide edge or by the guide groove of the moveable metal guide.

The advantage of the present invention is that after the catching in the thread-catching device, the thread can be released directly into the parking position. The guiding for transferring the thread and to form a thread reserve is essentially performed by the guide shaft of the pin thread guide, wherein the thread passes automatically from the deflected position back to a traversing center. The rapid release of the thread already within the parking position of the moveable metal guide has the added advantage that the thread-pulling forces on the thread caused by deflection are immediately effective to move the thread back to the traverse center. This effect is particularly advantageous for thread-catching devices that are formed on the periphery of the spool spindle so that after being caught, the thread must be led over the sleeve edge. In that regard, the apparatus of the invention is preferably suitable for such thread-catching devices that are formed directly on the spool spindle laterally adjacent to the spool housing.

At the storing and forming of the thread reserve, i.e., the storing of the piece of thread required for the knotting, that further development of the invention has proved particularly effective, in which the pin thread guide forms a thread guide track with the projecting guide shaft, in which the thread can be guided after having been released from the guide groove of the moveable metal guide. Thus, essentially a winding time for storing a thread after the catching of the piece of the thread in the thread-catching device can be determined. A complete release of the thread occurs only after passing the thread-guiding track on the guide shaft.

It has been found that the length of the guide shaft of the pin thread guide can directly influence the length of the thread piece stored in the thread reserve winding. In that regard, the further development of the invention is preferably designed such that the shaft of the pin thread guide has an adjustable length.

For this purpose, the guide shaft is preferably arranged on a body, which can be guided within a snap holder in several clip-stop positions.

In order to design the auxiliary device with a minimum of moving means, a further development of the invention is preferably used, in which the moveable metal guide has a guide edge laterally to the guide groove and in which the moveable metal guide can be moved into a catching position to catch the thread, and into a release position to release the thread. This means that all movements to catch and release the thread can be carried out by moving the moveable metal guide. Thus, the moveable metal guide in the receiving position can be transferred from the release position into the catching position in order to release the thread from the changing device. After transferring the thread into the parking position, the moveable metal guide in the parking position can be returned from the catching position into the release position to pass the thread to the thread guide pin.

Alternatively, it is possible to design the catching and transferring of the thread to the pin thread guide in the form of several moveable metal guides according to a further advantageous embodiment of the invention. This allows two moveable metal guides with two guide edges to be formed that cooperate in the catching and guiding of the thread. It is especially advantageous here that each moveable metal guide is moved back and forth only in one direction of motion. Thus, one of the moveable metal guides with a first guide edge can be moved into a catching position to catch the thread and into a release position to release the thread.

The second guide edge on the second moveable metal guide is preferably formed perpendicular to the first guide edge of the first moveable metal guide and transversely to the guide shaft of the pin thread guide in order to lead the thread from the receiving position into the parking position and to release it.

The apparatus of the invention is thus characterized in particular in that with a continuous winding up of an incoming thread with multiple spool spindles, very short changeover times and secure thread handover can be achieved. This allows the pieces of thread stored on the spool housing pieces to be limited to a minimum.

BRIEF DESCRIPTION OF THE DRAWINGS

The apparatus of the invention is explained below with reference to the accompanying drawings.

DETAILED DESCRIPTION

Figure 1:
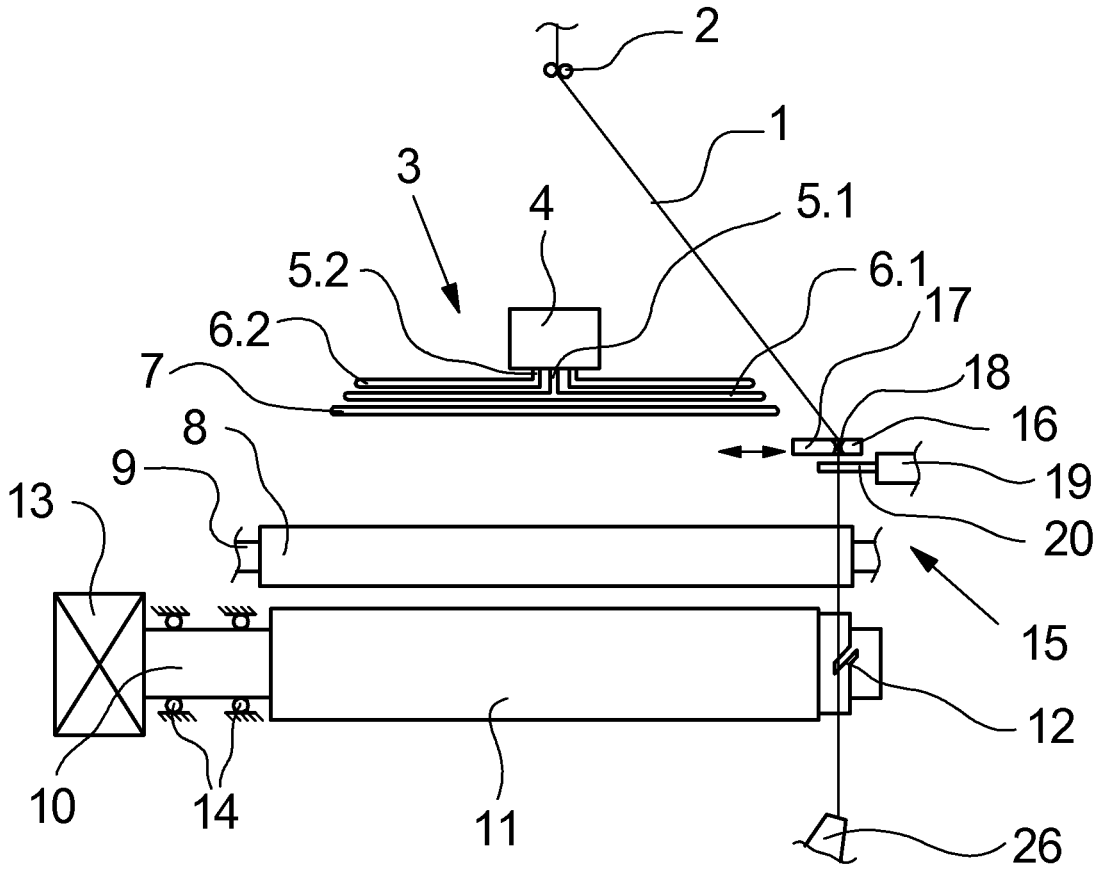
FIG. 1 is a schematic diagram of a side view of one embodiment of the inventive apparatus in an operating state.
Figure 2:
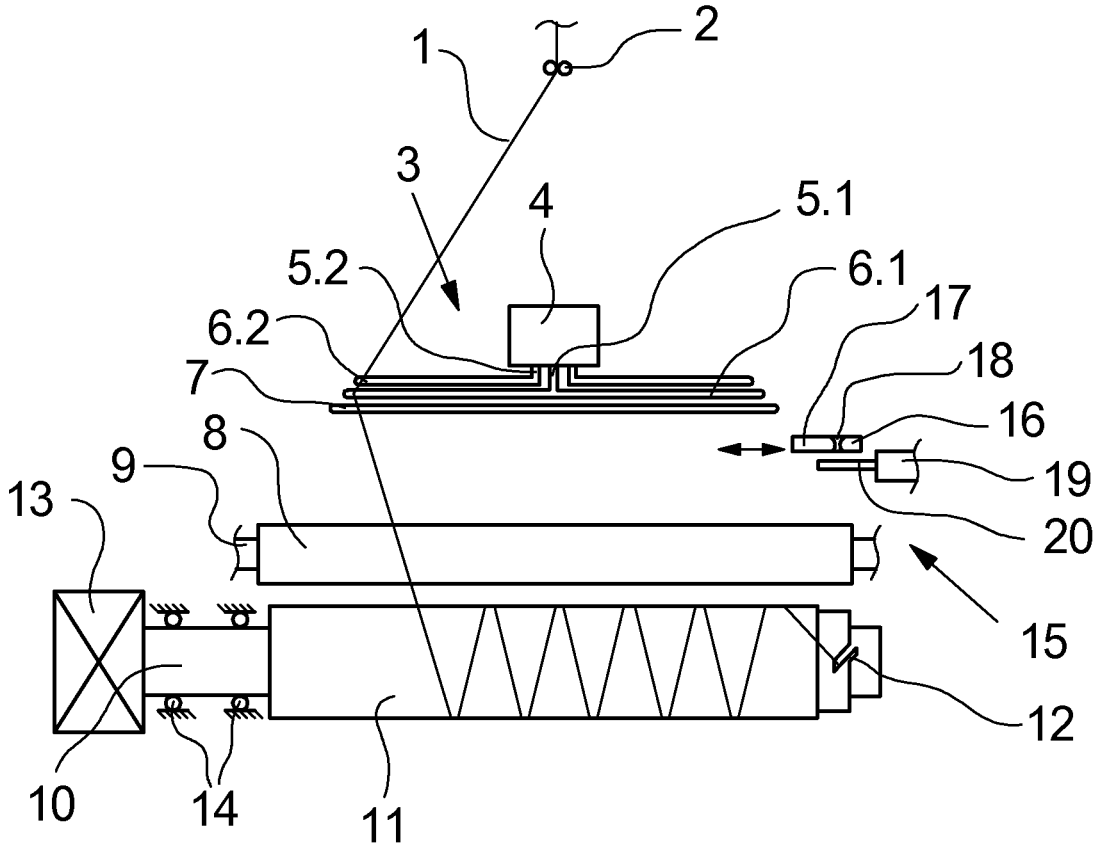
FIG. 2 is a schematic diagram of a side view of the embodiment of FIG. 1 in another state.

FIGS. 1 to 4 show a schematic view of an embodiment of the inventive apparatus for winding up a thread in several perspectives and operating conditions. FIGS. 1 and 2 each show a side view of the embodiment, and FIGS. 3 and 4 respectively show a plan view of the embodiment. Unless an express reference is made to the figures, the following description applies to all figures.

The apparatus for winding up an incoming thread 1 includes a spool spindle 10. The spool spindle 10 is mounted on one side by a bearing 14 in a support and is coupled with a spindle motor 13. The support is not shown in this embodiment, and is usually formed by a rotary plate having a second spool spindle, which is offset by 180° with respect to the first spool spindle. Such supports are particularly useful to continuously wind up an incoming thread onto a spool. For this purpose, the spool spindles are alternately moved into a winding position and a change position. Since, however, it is irrelevant for the explanation of the invention, whether one spool spindle or two spool spindles are held on the support, only one spool spindle 10 is explained on the illustrated embodiment.

On the periphery of the spool spindle 10 is clamped a spool housing 11. The spool housing 11 is associated at the free end of the spool spindle 10 with a thread-catching device 12, which is directly formed on the circumference of the spool spindle 10. Such thread-catching devices 12 are generally known and preferably include one or more catch hooks to catch an incoming thread.

A pressure roller 8 is located, axis-parallel to the spool spindle 10, at a short distance from the spool housing 11. The pressure roller 8 is rotatably mounted by a shaft 9 in a machine frame. Above the spool spindle 10 and the pressure roller 8 is provided a changing device 3. In this embodiment, the changing device 3 includes a traversing drive 4, which is connected to two oppositely driven rotors 5.1 and 5.2. To each of the rotors 5.1 and 5.2 are fixed traversing wings 6.1 and 6.2. The traversing wings 6.1 and 6.2 are driven by the rotors 5.1 and 5.2 in an opposite sense of rotation, wherein the free ends of the wings 6.1 and 6.2 respectively are guided along a guide plate 7, on which a thread 1 can be guided back and forth by the traversing wings 6.1 and 6.2 within a traverse hub.

Above the changing device 3 is arranged a stationary pin thread guide 2, which feeds the incoming thread 1 into the changing device 3. The stationary pin thread guide 2 is held in a traversing middle of the changing device 3 and forms the top of a so-called changing triangle.

Below the changing device 3 is arranged an auxiliary device 15, which is formed of a movably guided metal guide 16 and a stationary pin thread guide 19. As is particularly shown in FIGS. 3 and 4, the moveable metal guide 16 comprises guide edge 17 that faces the changing device and a guide groove 18. Here, the guide edge 17 leads into the guide groove 18. The moveable metal guide 16 is associated with two drives, which are not shown. A first linear drive leads the moveable metal guide 16 back and forth between a parking position and a receiving position. A second drive allows the moveable metal guide 16 to transfer between a catch position and a release position.

In the situations illustrated in FIGS. 1 to 4, the moveable metal guide 16 is held in a parking position laterally adjacent to the changing device 3. In the parking position, the moveable metal guide 16 cooperates with the pin thread guide 19. For this purpose, the pin thread guide 19 comprises a projecting guide shaft 20, which covers the guide groove 18 of the moveable metal guide 16.

In the embodiment of the inventive apparatus shown in FIGS. 1 to 4, it is common that at the start of a winding process, which is also called a winding cycle, the incoming thread must first be caught in the spool spindle 10. It is necessary that during the catching, the thread is passed outside the changing device 3. Regardless of whether the device comprises one spool spindle with manual operation or two spool spindles with an automatic spool changing, this operation must be carried out after each winding cycle. It is thus independent of whether the thread end shown in FIG. 1 is received by a just finished wound spool or is led by way of a hand injector.

Figure 3:
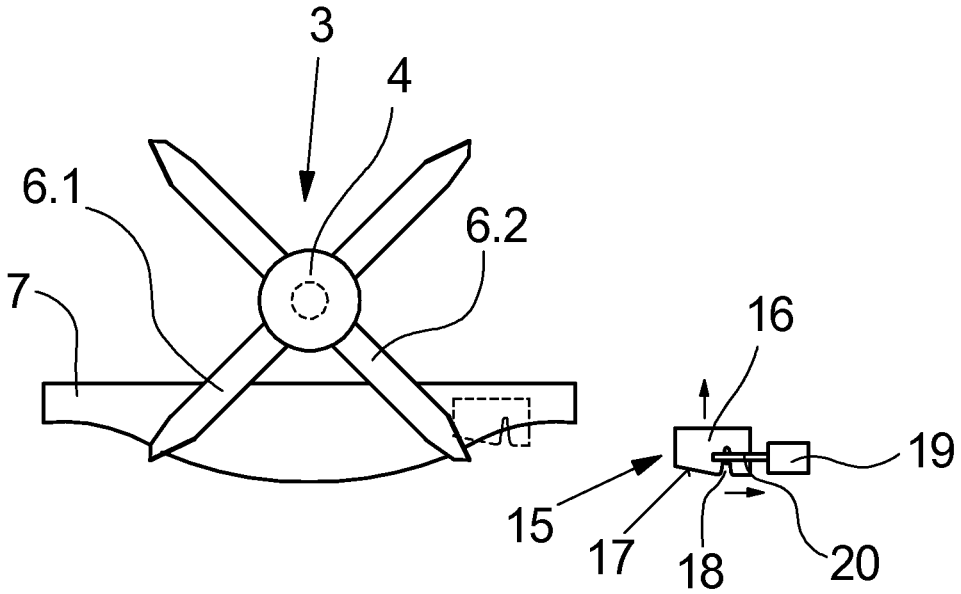
FIG. 3 is a schematic plan view of the embodiment of FIG. 1 in an operating position.
Figure 4:
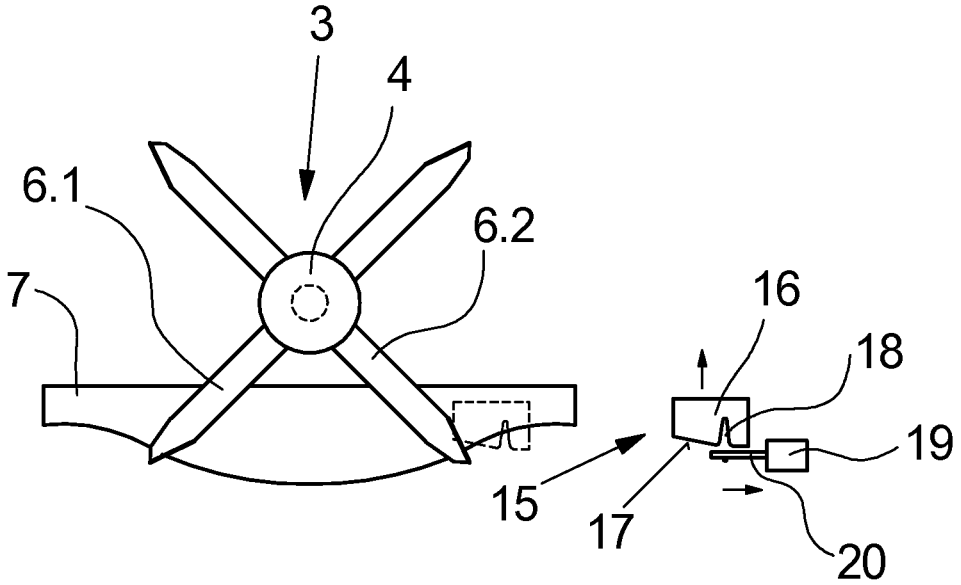
FIG. 4 is a schematic plan view of the embodiment of FIG. 1 in another operating position.

In order to be able to start a new winding cycle, the thread 1 is therefore first led out of the changing device 3. For this purpose, the moveable metal guide 16 is transferred from the parking position laterally beside the changing device 3 into a receiving position in the changing device 3. In FIGS. 3 and 4, the moveable metal guide in the receiving position is illustrated by dashed lines. In the receiving position, the guide edge 17 of the moveable metal guide 16 passes beneath the guide plate 7 in the region of the thread guiding such that during the traverse the thread is automatically guided over the guide edge 17 into the guide groove 18 of the moveable metal guide 16. As soon as the thread 1 dips in the guide groove 18 of the moveable metal guide 16, a further non-illustrated drive of the moveable metal guide 16 is activated in order to lead the moveable metal guide 16 into a catching position, in which the thread is held away from the influence range of the traversing wings 6.1 and 6.2. Subsequently, the moveable metal guide 16 is returned by the linear drive into the parking position. In FIGS. 1 and 3, this situation is shown directly. In the parking position of the moveable metal guide, the guide shaft 20 of the pin thread guide 19 covers the guide groove 18 of the moveable metal guide 16.

As can especially be seen in FIG. 1, in this situation, the incoming thread 1 is fed directly into the thread-catching device 12 on the periphery of the spool spindle 10. For this purpose, with a manual spool change, an operator holds a hand injector 26 such that the thread piece tensioned between the moveable metal guide 16 and the hand injector 26 is supplied to the thread-catching device 12 on the periphery of the spool spindle 10.

In the event that a second spool spindle is held with a full spool on the spindle support, the thread guiding on the outlet side of the spool spindle 10 is carried out by additional thread guide means. Thus, the thread 1 is captured by the catch means of the thread-catching device 12. In this situation, the moveable metal guide 16 in the parking position is transferred from the catching position back into the release position so that the thread 1 slides from the thread-guiding groove 18 and at first is held on the guide shaft 20 of the pin thread guide 19. This situation is particularly clear from the diagram in FIG. 4. Now, the thread glides along the guide shaft 20 to the traversing center. After the catch on the capture device 12, the thread 1 is led to the spool housing 11. The thread 1 is wound up on the circumference of the spool housing 10 with a thread reserve, which is essentially formed by a partial winding. Upon reaching the changing device 3, the thread 1 is captured by the traversing wings 6.1 and 6.2, and is led back and forth, so that the new winding cycle can begin. This process is shown in the diagram in FIG. 2.

In particular at the initial stage, in which the thread reserve is formed, the initial winding of thread is substantially affected by the slowed-down guiding of the thread on the guide shaft 20 of the pin thread guide 19. The sliding of the thread along the guide shaft 20 of the pin thread guide 19 is acted upon mainly by the thread pulling forces caused by the deflection, which lead the thread back to the middle of traversing.

It has been found that, depending on the thread titer and the process, the length of the guide shaft has a significant impact on the length of the thread stored in the thread reserve. In that regard, the guide shaft 20 is preferably constructed to be variable in length.

Figure 5:
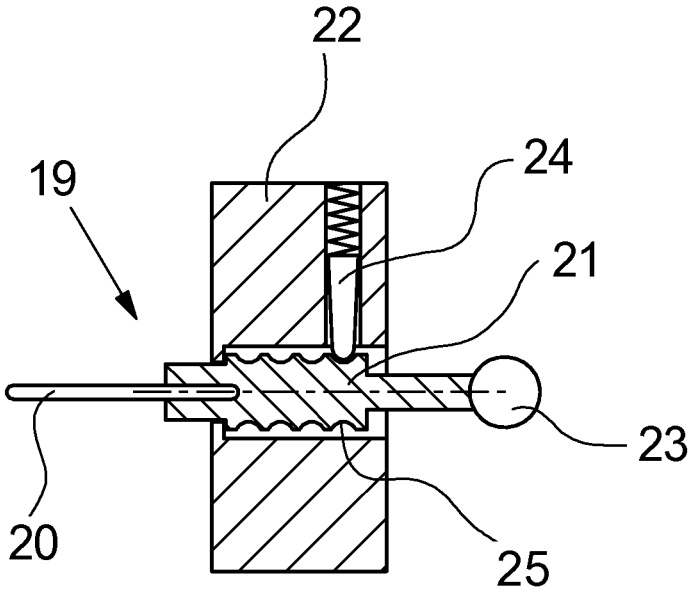
FIG. 5 is a schematic cross-sectional view of a pin thread guide of the embodiment of FIG. 1.

FIG. 5 shows an embodiment of a possible pin thread guide 19, as it would be used, for example, in the embodiment shown in FIG. 1. The pin thread guide 19 has a guide shaft 20, which is arranged on a locking body 21. The locking body 21 is held in a locking holder 22. The locking holder 22 comprises a spring-loaded latching element, which acts on a circumferential groove 25 of the locking body 21. On the locking body 21, on the side opposite to the guide shaft 20 is provided an actuating means 23 so that by rotating the locking member 21 by the actuating means 23, the projecting length of the guide shaft 20 is adjustable continuously or in increments.

The embodiment of the pin thread guide shown in FIG. 5 is only an example. There is also the possibility that the locking holder has a thread, in which a male thread of the locking body is guided. In order to allow a stepwise adjustment of the guide shaft, the locking body has, in addition to the thread, a second section having, for example, a pair of axially oriented grooves, which cooperate with a locking element within the locking holder. Thus, by each turn the thread the locking member can be fixed in two positions. With a thread of the size M12×1, the length of the guide shaft could so be adjusted in increments of 0.5 mm.

Figure 6:
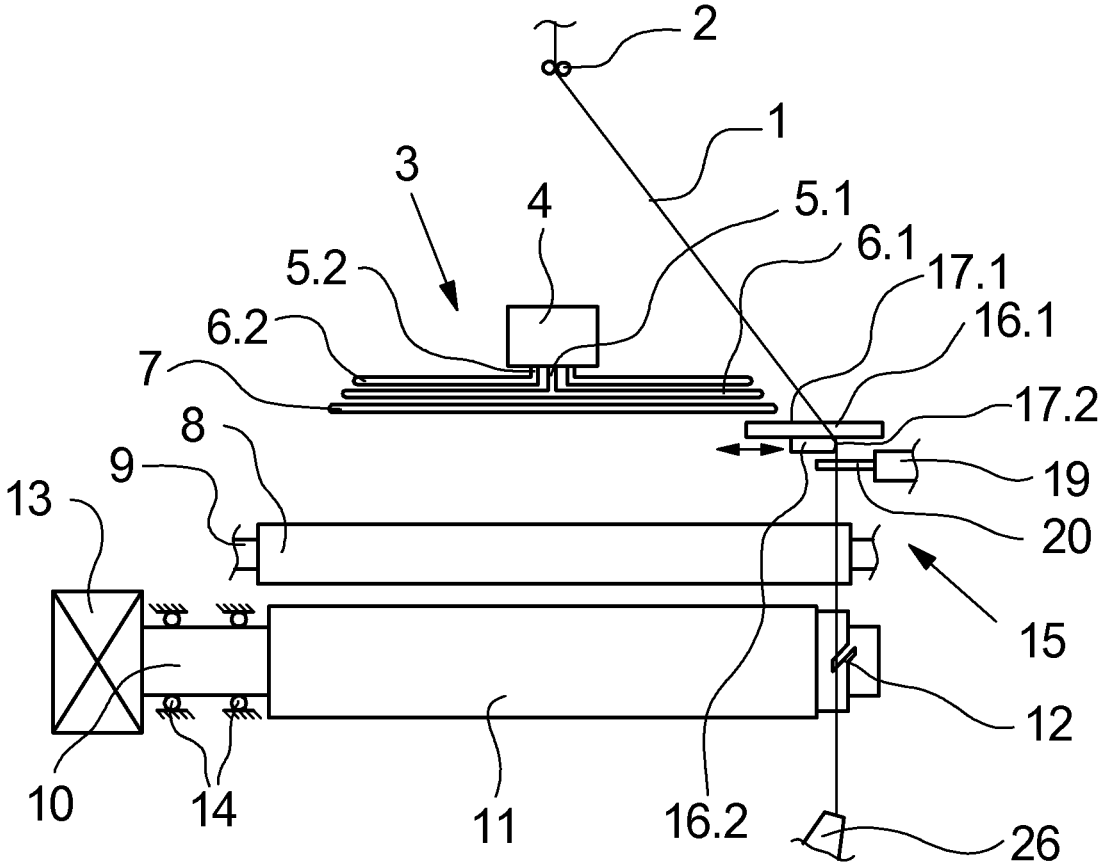
FIG. 6 is a schematic side view of another embodiment of the apparatus of the invention.
Figure 7:
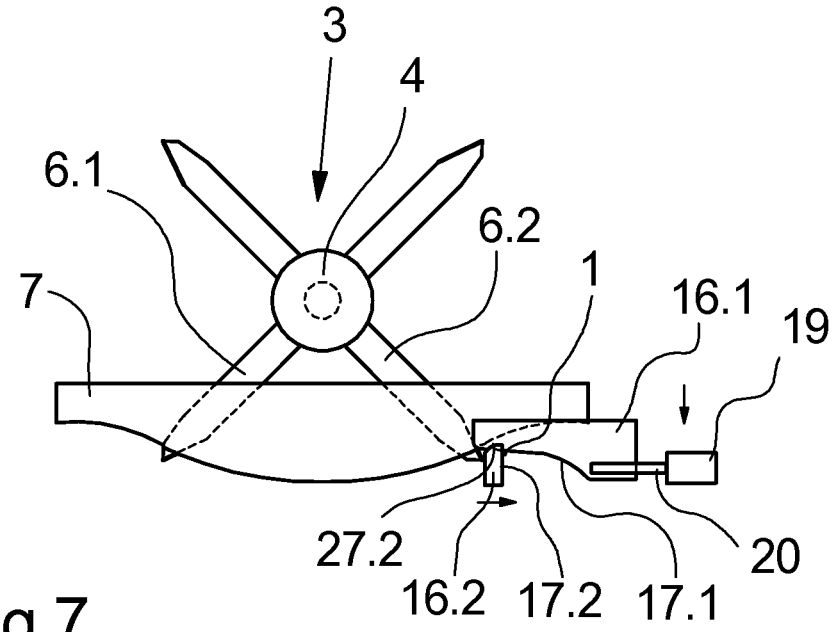
FIG. 7 is a schematic plan view of the embodiment of FIG. 6 in an operating position.
Figure 8:
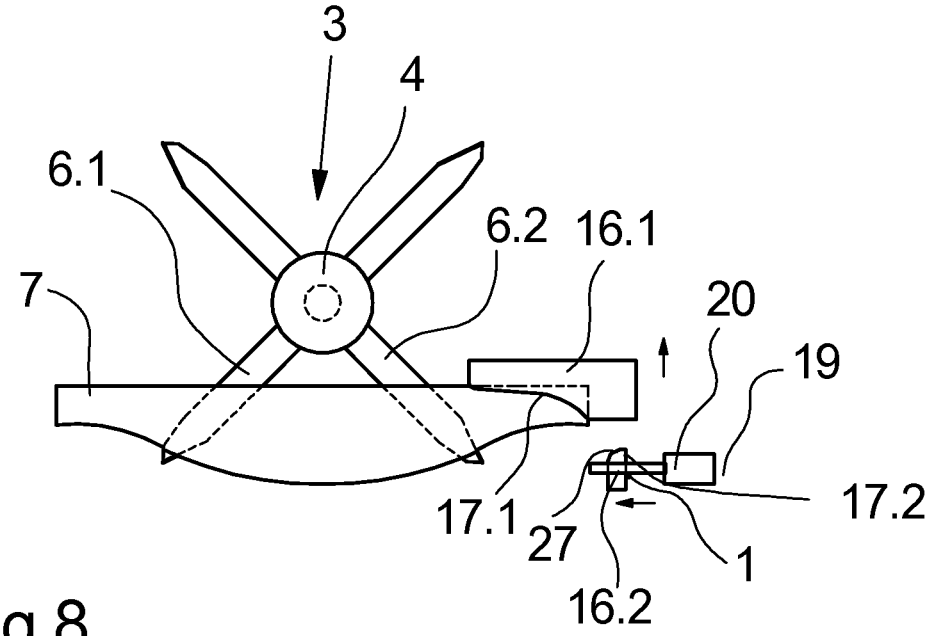
FIG. 8 is a schematic plan view of the embodiment of FIG. 6 in another operating position.

FIGS. 6, 7 and 8 show another embodiment of the inventive apparatus for winding up a thread, schematically shown in several views and modes of operation. FIG. 6 shows a side view of the embodiment and FIGS. 7 and 8 respectively show a plan view of the embodiment seen from a bottom side. Unless an express reference is made to the figures, the following description applies to all figures.

The embodiment illustrated in FIGS. 6 to 8 is substantially identical to the embodiment of FIGS. 1 to 4, so that at this point only the differences are explained and otherwise reference is made to the above description. In the embodiment shown in FIGS. 6 to 8, all the components, except for the auxiliary device 15, are configured identically to the aforementioned embodiment. In this embodiment, the auxiliary device 15 consists of two moveable metal guides 16.1 and 16.2, which are arranged below the guide plate 7 and are configured to receive the thread of the changing device 3.

As can be seen in the particular representations shown in FIGS. 7 and 8, the first moveable metal guide 16.1 comprises a first guide edge 17.1, to which extends the pin thread guide 19 that is arranged in a region between the changing device 3 and laterally adjacent to the changing device. A guide shaft 20 of the pin thread guide 19 protrudes into the area of influence of the guide edge 17.1 of the moveable metal guide 16.1. The moveable metal guide 16.1 can be moved back and forth between a catching position 15 and a release position in a first direction of movement. FIG. 7 shows the moveable metal guide 16.1 in the catching position and FIG. 8 in the release position.

The first moveable metal guide 16.1 is associated with a second moveable metal guide 16.2, which includes, on an outwardly facing side, a second guide edge 17.2. The guide edge 17.2 on the moveable metal guide 16.2 is aligned transverse to the guide edge 17.1 of the moveable metal guide 16.1 and transverse to the guide shaft 20 of the pin thread guide 19. The second moveable metal guide 16.2 can be moved back and forth between a receiving position and a parking position. FIG. 7 shows the moveable metal guide 16.2 in a receiving position and FIG. 8 shows it in the parking position.

The moveable metal guide 16.2 includes, on the side facing away from the guide edge 17.2, a sliding edge 27, along which the thread slides to the takeover to enter the area of the guide edge 17.2.

To explain the operation of the auxiliary device 15, reference is first made to FIG. 7. In order to guide the thread 1 from the changing device 3, the moveable metal guide 16.1 is transferred into the catch position. Simultaneously, the second moveable metal guide 16.2 is moved into the receiving position, wherein the directions of movement of the moveable metal guides 16.1 and 16.2 are directed orthogonal to each other. Each of the moveable metal guides 16.1 and 16.2 is associated with a separate actuator (not shown here). In the receiving position, the thread 1 that is guided by the wings

6.1, 6.2 to the changing device 3 is captured by cooperation of the two guide surfaces 16.1 and 16.2, and subsequently guided by moving the moveable metal guide 16.2 in the direction of the pin thread guide 19 along the guide edge 17.1 of the moveable metal guide 16.1. The guide edge 17.1 is formed in the catching position of the moveable metal guide 16.1 such that the thread 1 is guided by progressive movement of the moveable metal guide 16.2 behind the guide shaft 20 of the pin thread guide 19.

Regarding the release of the thread, we refer to the representation of the auxiliary device shown in FIG. 8. Just before the thread is caught in a catch device 20 of a spool spindle and a new winding cycle can be started, the moveable metal guide 16.1 is returned from the catching position to the release position. Here, the thread is passed from the guide edge 17.1 to the guide shaft 20 of the pin thread guide 19 so that for the guiding of the thread, the second moveable metal guide 16.2 and the pin thread guide 19 cooperate. Premature slippage of the thread from the guide edge 17.2 along the moveable metal guide 16.2 can thus be prevented. The moveable metal guide 16.2 is now moved from the parking position in the direction of the receiving position so that at the end of the guide shaft 20, a final release of the thread 1 occurs. The set-up length of the guide shaft 20 of the pin thread guide 19 determines the point in time, at which the thread is released and arrives back into the changing device 3. This makes it possible, in particular, to influence the amount of time, in which the thread is wound up as a thread reserve.

In the embodiment shown in FIGS. 6 to 8, the process of capturing the thread and of winding up the thread on a spool spindle is identical to the aforementioned embodiment so that no further explanation is provided at this point.

| List Of Reference Numbers | |
|---|---|
| 1 | Thread |
| 2 | Stationary pin thread guide |
| 3 | Changing device |
| 4 | Changing drive |
| 5.1, 5.2 | Rotor |
| 6.1, 6.2 | Traversing wings |
| 7 | Guide plate |
| 8 | Pressure roller |
| 9 | Axis |
| 10 | Spindle spool |
| 11 | Spool housing |
| 12 | Thread-catching device |
| 13 | Spindle motor |
| 14 | Bearing |
| 15 | Auxiliary device |
| 16, 16.1, 16.2 | Moveable metal guide |
| 17, 17.1, 17.2 | Guide edge |
| 18 | Guide groove |
| 19 | Pin thread guide |
| 20 | Guide shaft |
| 21 | Locking body |
| 22 | Locking holder |
| 23 | Actuator |
| 24 | Latching element |

-continued

| List Of Reference Numbers | |
|---|---|
| 25 | Groove |
| 26 | Hand injector |
| 27 | Sliding edge |

The invention claimed is:

1. An apparatus for winding up a thread with at least one drivable spool spindle comprising:

at least one spool housing and thread catch device associated with the spool housing;

a changing device for a back and forth movement of the thread; and an auxiliary device for guiding the thread during catching and winding up of the thread, wherein the auxiliary device comprises at least one moveable guide with a guide edge and/or a guide groove for the guiding of the thread;

wherein the moveable guide is associated with the changing device and can be moved between a receiving position in a region of the changing device and a parking position at a side of the changing device, wherein the moveable guide in the parking position is associated with a pin thread guide that cooperates with a guide shaft for guiding the thread with the guide edge or the guide groove of the moveable guide and wherein the guide shaft defines a thread-guide track, on which the thread can be guided to be released from the guide edge or from the guide groove of the moveable guide, and the guide shaft of the pin thread guide has an adjustable length.

2. The apparatus according to claim 1, wherein the guide shaft is arranged on a locking element so that the guide shaft can be moved into a plurality of locked positions within a latching holder.

3. The apparatus according to claim 1 including both the guide edge and the guide grove, wherein the guide edge is laterally adjacent to the guide groove and wherein the moveable guide is moveable to a catching position to catch the thread and moveable to a release position to release the thread.

4. The apparatus according to claim 3, wherein the moveable guide in the receiving position can be transferred from the release position into the catching position, and wherein the moveable guide in the parking position can be moved from the catching position into the release position.

5. The apparatus according to claim 4, wherein an overlap of the guide groove formed by the pin thread guide in the catching position and in the release position is equal.

6. The apparatus according to claim 1 comprising two independently moveable guides with respective guide edges, and that to catch the thread, one of the moveable guides with a first guide edge can be moved into a catching position, and to release the thread, it can be moved into a release position.

7. The apparatus according to claim 6, wherein a second guide edge is formed on the second moveable guide transverse to the first guide edge of the first moveable guide and transverse to the guide shaft of the pin thread guide.

* * * * *